US008845356B2

(12) United States Patent
Cheatham et al.

(10) Patent No.: US 8,845,356 B2
(45) Date of Patent: Sep. 30, 2014

(54) POWER ADAPTER CORD HAVING LOCKING CONNECTOR

(71) Applicant: InVue Security Products Inc., Charlotte, NC (US)

(72) Inventors: Thomas Reid Cheatham, Charlotte, NC (US); Barry John Green, Lincolnton, NC (US); Gary Andrew Taylor, Fort Mill, SC (US); Robert O. Hartweg, Waxhaw, NC (US)

(73) Assignee: InVue Security Products Inc., Charlotte, NC (US)

( * ) Notice: Subject to any disclaimer, the term of this patent is extended or adjusted under 35 U.S.C. 154(b) by 59 days.

(21) Appl. No.: 13/755,241

(22) Filed: Jan. 31, 2013

(65) Prior Publication Data

US 2013/0196530 A1 Aug. 1, 2013

Related U.S. Application Data

(60) Provisional application No. 61/592,852, filed on Jan. 31, 2012.

(51) Int. Cl.

| | |
|---|---|
| ***H01R 13/627*** | (2006.01) |
| ***H01R 13/62*** | (2006.01) |
| ***H01R 43/26*** | (2006.01) |
| ***H01R 31/06*** | (2006.01) |
| *H01R 13/639* | (2006.01) |

(52) U.S. Cl.

CPC ..... *H01R 13/62* (2013.01); *H01R 13/6397* (2013.01); *H01R 43/26* (2013.01); *H01R 31/065* (2013.01); *H01R 13/6275* (2013.01); *H01R 31/06* (2013.01)

USPC ..... 439/357; 439/304

(58) Field of Classification Search

CPC ..... H01R 13/6275; H01R 13/6397; H01R 13/6282

USPC ..... 439/357, 304

See application file for complete search history.

(56) References Cited

U.S. PATENT DOCUMENTS

| | | | | |
|---|---|---|---|---|
| 5,190,466 | A * | 3/1993 | McVey | 439/304 |
| 5,580,268 | A * | 12/1996 | Miyazawa | 439/352 |
| 5,634,809 | A * | 6/1997 | Hirai | 439/352 |

(Continued)

OTHER PUBLICATIONS

Tyco Electronics, Innovative New Micro-USB Connector Brings Applications Down to Size, Aug. 9, 2007, Harrisburg, Pennsylvania.

(Continued)

*Primary Examiner* — Ross Gushi

(74) *Attorney, Agent, or Firm* — InVue Security Products Inc.

(57) ABSTRACT

A power adapter cord for providing electrical power to an electronic item of merchandise from an external source of electrical power includes a cable containing at least one conductor and having a connector at one end configured to lock into a corresponding connector of a power input port provided on the item of merchandise. The connector and the corresponding connector define a mechanical and electrical connection having a connector extraction force greater than the connector extraction force of a standard connector of the same type. Accordingly, the connector prevents accidental or malicious removal of the connector from the power input port and/or discourages theft of the item of merchandise because the connector cannot be forcibly removed without damaging the corresponding connector and thereby rendering the item of merchandise inoperable. In exemplary embodiments, the connector is a modified micro-USB plug.

18 Claims, 4 Drawing Sheets

(56) References Cited

U.S. PATENT DOCUMENTS

| | | | | |
|---|---|---|---|---|
| 5,772,461 | A * | 6/1998 | Yu | 439/352 |
| 6,056,578 | A * | 5/2000 | Lin | 439/358 |
| 6,364,687 | B1 * | 4/2002 | Chen | 439/358 |
| 6,491,541 | B2 * | 12/2002 | Wakino | 439/451 |
| 6,522,532 | B2 * | 2/2003 | Liao et al. | 361/679.43 |
| 6,581,421 | B2 | 6/2003 | Chmela et al. | |
| 6,595,792 | B1 | 7/2003 | Rudolph et al. | |
| 6,619,976 | B2 * | 9/2003 | Huetter et al. | 439/352 |
| 6,796,152 | B1 * | 9/2004 | Yu | 70/58 |
| 6,799,981 | B1 * | 10/2004 | Yu | 439/133 |
| 6,832,926 | B2 | 12/2004 | Rudolph et al. | |
| 6,902,432 | B2 * | 6/2005 | Morikawa et al. | 439/607.41 |
| 6,929,501 | B2 * | 8/2005 | Huang | 439/362 |
| 6,991,479 | B2 * | 1/2006 | Miao | 439/133 |
| 7,014,490 | B1 * | 3/2006 | Morikawa et al. | 439/352 |
| 7,033,218 | B2 * | 4/2006 | Huang et al. | 439/607.04 |
| 7,081,002 | B2 * | 7/2006 | de Vanssay et al. | 439/350 |
| 7,094,099 | B2 * | 8/2006 | Daggett et al. | 439/567 |
| 7,128,588 | B2 * | 10/2006 | Hu et al. | 439/159 |
| 7,128,595 | B2 * | 10/2006 | Boutros | 439/358 |
| 7,134,900 | B2 * | 11/2006 | Chung | 439/353 |
| 7,160,137 | B1 * | 1/2007 | Yeh | 439/358 |
| 7,175,465 | B1 * | 2/2007 | Tsai | 439/352 |
| 7,192,295 | B1 * | 3/2007 | Yeh | 439/350 |
| 7,214,087 | B2 * | 5/2007 | Kuo | 439/364 |
| 7,258,565 | B2 * | 8/2007 | Huang et al. | 439/353 |
| 7,270,560 | B1 | 9/2007 | Bodmann et al. | |
| 7,273,397 | B2 * | 9/2007 | Watanabe et al. | 439/607.27 |
| 7,285,004 | B1 * | 10/2007 | Fukuda et al. | 439/358 |
| 7,314,383 | B1 * | 1/2008 | Ho et al. | 439/353 |
| 7,422,465 | B2 * | 9/2008 | Watanabe et al. | 439/353 |
| 7,428,834 | B1 * | 9/2008 | Lee | 70/57 |
| 7,442,066 | B1 * | 10/2008 | Ho et al. | 439/358 |
| 7,455,545 | B2 * | 11/2008 | Chawgo et al. | 439/353 |
| 7,465,181 | B1 * | 12/2008 | Bridges et al. | 439/358 |
| 7,484,991 | B1 * | 2/2009 | Kelaher et al. | 439/372 |
| 7,537,483 | B2 * | 5/2009 | Lin et al. | 439/607.01 |
| 7,540,754 | B2 * | 6/2009 | Hankey et al. | 439/348 |
| 7,572,139 | B2 * | 8/2009 | Montena | 439/358 |
| 7,578,691 | B2 * | 8/2009 | Weksler et al. | 439/347 |
| 7,635,272 | B2 * | 12/2009 | Poppe | 439/133 |
| 7,677,065 | B1 * | 3/2010 | Miao | 70/57 |
| 7,682,182 | B2 * | 3/2010 | Kondo et al. | 439/353 |
| 7,722,369 | B2 * | 5/2010 | Bushby | 439/134 |
| 7,722,409 | B2 * | 5/2010 | Takamoto et al. | 439/660 |
| 7,753,712 | B2 * | 7/2010 | Miki | 439/353 |
| 7,815,460 | B2 * | 10/2010 | Lin | 439/358 |
| 7,824,221 | B2 * | 11/2010 | Miyoshi | 439/607.41 |
| 7,824,222 | B2 * | 11/2010 | Miyoshi et al. | 439/607.41 |
| 7,833,058 | B2 * | 11/2010 | Zhang et al. | 439/607.41 |
| 7,836,551 | B2 * | 11/2010 | Hung et al. | 16/319 |
| 7,845,965 | B2 * | 12/2010 | Ko | 439/352 |
| 7,878,840 | B2 * | 2/2011 | Hankey et al. | 439/348 |
| 7,878,865 | B2 * | 2/2011 | Desrosiers et al. | 439/680 |
| 7,892,014 | B2 * | 2/2011 | Amidon et al. | 439/353 |
| 7,913,527 | B2 * | 3/2011 | Chen | 70/57 |
| 8,025,511 | B2 * | 9/2011 | Aihara et al. | 439/141 |
| 8,033,853 | B2 * | 10/2011 | Chang | 439/304 |
| 8,083,535 | B2 * | 12/2011 | Chang | 439/357 |
| 8,092,241 | B2 * | 1/2012 | Chang | 439/305 |
| 8,152,557 | B2 * | 4/2012 | Blanton et al. | 439/362 |
| 8,152,566 | B1 * | 4/2012 | Little et al. | 439/607.41 |
| 8,162,694 | B2 * | 4/2012 | Hisada et al. | 439/607.23 |
| 8,287,299 | B2 * | 10/2012 | Ray et al. | 439/353 |
| 8,360,797 | B2 * | 1/2013 | Deng et al. | 439/345 |
| 8,408,932 | B2 | 4/2013 | Villarreal et al. | |
| 8,414,314 | B1 * | 4/2013 | Mosholder | 439/148 |
| 8,425,249 | B2 * | 4/2013 | Hackett et al. | 439/357 |
| 8,439,708 | B2 * | 5/2013 | Colantuono et al. | 439/660 |
| 8,449,309 | B1 * | 5/2013 | Mosholder | 439/148 |
| 8,517,748 | B1 * | 8/2013 | Kelsch et al. | 439/188 |
| 8,529,283 | B1 * | 9/2013 | Carden | 439/347 |
| 8,542,483 | B2 * | 9/2013 | Huang | 361/679.32 |
| 8,545,254 | B2 * | 10/2013 | Amidon | 439/353 |
| 8,696,377 | B2 * | 4/2014 | Kelsch et al. | 439/489 |
| 2003/0157836 | A1 * | 8/2003 | Morikawa et al. | 439/607 |
| 2003/0224637 | A1 * | 12/2003 | Ling | 439/133 |
| 2004/0074264 | A1 * | 4/2004 | Kung et al. | 70/58 |
| 2005/0039502 | A1 * | 2/2005 | Avganim | 70/58 |
| 2005/0174238 | A1 * | 8/2005 | Foseide | 340/568.4 |
| 2005/0202698 | A1 * | 9/2005 | Miao | 439/133 |
| 2005/0245132 | A1 * | 11/2005 | Huang et al. | 439/607 |
| 2005/0250369 | A1 * | 11/2005 | Ferderer | 439/352 |
| 2005/0282424 | A1 * | 12/2005 | Huang et al. | 439/353 |
| 2006/0094293 | A1 * | 5/2006 | Daggett et al. | 439/544 |
| 2006/0107073 | A1 * | 5/2006 | Lane et al. | 713/194 |
| 2006/0134962 | A1 * | 6/2006 | Yeh | 439/352 |
| 2006/0148300 | A1 * | 7/2006 | Huang et al. | 439/353 |
| 2006/0211291 | A1 * | 9/2006 | Kung | 439/352 |
| 2006/0216991 | A1 * | 9/2006 | Boutros | 439/607 |
| 2007/0004265 | A1 * | 1/2007 | Yeh | 439/358 |
| 2007/0037454 | A1 * | 2/2007 | Bushby | 439/680 |
| 2007/0049100 | A1 * | 3/2007 | Tsai | 439/352 |
| 2007/0099504 | A1 * | 5/2007 | Wu | 439/607 |
| 2007/0149054 | A1 * | 6/2007 | Watanabe et al. | 439/607 |
| 2007/0155243 | A1 * | 7/2007 | Watanabe et al. | 439/610 |
| 2007/0162655 | A1 * | 7/2007 | Huang | 710/36 |
| 2007/0254514 | A1 * | 11/2007 | Weksler et al. | 439/296 |
| 2007/0277566 | A1 * | 12/2007 | Yu | 70/58 |
| 2008/0041125 | A1 * | 2/2008 | Poppe | 70/57 |
| 2008/0067082 | A1 * | 3/2008 | Huang | 206/1.5 |
| 2008/0200058 | A1 * | 8/2008 | Tsai | 439/353 |
| 2008/0311783 | A1 * | 12/2008 | Miki | 439/370 |
| 2009/0004916 | A1 * | 1/2009 | Miyoshi et al. | 439/610 |
| 2009/0079566 | A1 * | 3/2009 | Goldstein et al. | 340/568.1 |
| 2009/0088013 | A1 * | 4/2009 | Lin et al. | 439/296 |
| 2009/0088023 | A1 * | 4/2009 | Bridges et al. | 439/607 |
| 2009/0088025 | A1 * | 4/2009 | Lin et al. | 439/607 |
| 2009/0124125 | A1 * | 5/2009 | Chatterjee | 439/607.05 |
| 2009/0325417 | A1 * | 12/2009 | Ko | 439/350 |
| 2010/0015838 | A1 * | 1/2010 | Blanton et al. | 439/359 |
| 2010/0041265 | A1 * | 2/2010 | Wang | 439/353 |
| 2010/0062642 | A1 * | 3/2010 | Zhang et al. | 439/607.41 |
| 2010/0184313 | A1 | 7/2010 | Morrison et al. | |
| 2010/0279547 | A1 * | 11/2010 | Chang | 439/607.53 |
| 2010/0285683 | A1 * | 11/2010 | Zhang | 439/357 |
| 2010/0291783 | A1 * | 11/2010 | Chang | 439/304 |
| 2010/0307204 | A1 * | 12/2010 | Yu | 70/58 |
| 2010/0311283 | A1 * | 12/2010 | Desrosiers et al. | 439/680 |
| 2010/0317215 | A1 * | 12/2010 | Chang | 439/305 |
| 2011/0067460 | A1 * | 3/2011 | Niwa et al. | 70/58 |
| 2011/0097932 | A1 * | 4/2011 | Aihara et al. | 439/607.01 |
| 2011/0256756 | A1 * | 10/2011 | Lu et al. | 439/449 |
| 2012/0118031 | A1 * | 5/2012 | Hung et al. | 70/279.1 |
| 2012/0252255 | A1 * | 10/2012 | Colantuono et al. | 439/353 |
| 2012/0295462 | A1 * | 11/2012 | Villarreal et al. | 439/304 |
| 2012/0295467 | A1 * | 11/2012 | Deng et al. | 439/345 |
| 2012/0329331 | A1 * | 12/2012 | Liao et al. | 439/640 |
| 2013/0196530 | A1 * | 8/2013 | Cheatham et al. | 439/357 |
| 2013/0241731 | A1 * | 9/2013 | Fawcett et al. | 340/568.2 |
| 2013/0273767 | A1 * | 10/2013 | Phan et al. | 439/358 |
| 2013/0273784 | A1 * | 10/2013 | Little et al. | 439/660 |
| 2013/0295796 | A1 * | 11/2013 | Kato et al. | 439/660 |
| 2013/0309901 | A1 * | 11/2013 | Hilbourne | 439/502 |
| 2013/0344705 | A1 * | 12/2013 | Mikhnenko | 439/13 |
| 2014/0024259 | A1 * | 1/2014 | Kelsch et al. | 439/620.01 |
| 2014/0038449 | A1 * | 2/2014 | Fallon et al. | 439/370 |
| 2014/0057487 | A1 * | 2/2014 | May | 439/530 |
| 2014/0109630 | A1 * | 4/2014 | Tao | 70/15 |
| 2014/0130555 | A1 * | 5/2014 | Clark | 70/58 |

OTHER PUBLICATIONS

James R. Koser, et al., Universal Serial Bus 3.0 Connectors and Cable Assemblies Compliance Document, Oct. 4, 2011.

"Notification of Transmittal of International Search Report and Written Opinion of the International Searching Authority, or the Declaration" in counterpart International Patent Application No. PCT/US2013/024050; 10 pages.

* cited by examiner

POWER ADAPTER CORD HAVING LOCKING CONNECTOR

CROSS REFERENCE TO RELATED APPLICATIONS

This non-provisional utility patent application claims the benefit of U.S. Provisional Application No. 61/592,852, filed on Jan. 31, 2012.

FIELD OF THE INVENTION

This invention relates generally to merchandise display systems and merchandise security devices that provide power to an electronic item of merchandise. More particularly, the invention is a power adapter cord having a connector at one end configured to lock into the power input port of an electronic item of merchandise being displayed on a merchandise display system and/or protected from theft by a merchandise security device. In certain embodiments, the connector has an extraction force that is greater than the maximum extraction force specified for a standardized connector. In other embodiments, a special tool is required to remove the connector from the power input port without causing damage to the connector or to the power input port of the electronic item of merchandise.

BACKGROUND OF THE INVENTION

Retailers routinely display electronic items of merchandise, such as mobile (e.g. cellular) telephones, audio players, game consoles, personal data assistants (PDAs), digital cameras, DSLRs, laptop computers, tablets, e-readers and the like, for customers to examine before making a purchase. Retailers often desire the item of merchandise to be powered so that the customer can operate the item of merchandise and evaluate its features. At the same time, the retailers do not want the item of merchandise to be stolen or removed from the display area by an unauthorized person. Accordingly, the item of merchandise may be operatively coupled to a merchandise security device including a power adapter cord that monitors and protects the item of merchandise from theft or removal. The merchandise security device or a remote alarm module includes sensor electronics for monitoring whether the power adapter cord remains securely attached and electrically coupled to the item of merchandise. In particular, the sensor electronics trigger an audible or visible alarm to alert store personnel of a possible theft in the event that the power adapter cord is detached from the electronic item of merchandise, or alternatively, the power adapter cord is cut, severed or kinked excessively such that the electrical connection with the item of merchandise is interrupted. When required by the item of merchandise, the merchandise security device may also include power electronics, such as a transformer, voltage regulator, or the like, for providing an appropriate level of power or voltage to operate the displayed item of merchandise.

Merchandise display systems for displaying and powering an electronic item of merchandise and merchandise security devices for additionally protecting the item from theft in the aforementioned manner are known. It is also known to provide a power adapter cord for electrically coupling an electronic item of merchandise to an external power source. For example, the power adapter cord may be the voltage transformer and power cable supplied by the manufacturer of the item of merchandise and commonly referred to as a "charging cable." Alternatively, the power adapter cord may be a relatively short cable, commonly referred to as a "pigtail," that electrically couples the item of merchandise to the electrical power signal of a merchandise display system or to the power electronics of a merchandise security device. In the latter instance, the power electronics may include electrical leads connected to a power output port provided on the merchandise display device such that the power adapter cord electrically couples the power output port of the merchandise security device to a power input port on the item of merchandise. As a result, the power adapter cord has a preselected connector at one end that engages the power output port provided on the merchandise display device. In an alternative arrangement, the preselected connector is omitted and the end of the power adapter cord is permanently connected, such as hardwired, directly to the power electronics.

In the past, the other end of the power adapter cord required numerous different connectors to electrically couple the power electronics of the merchandise security device to the particular type of power input port provided on the item of merchandise. Recently, manufacturers of electronic items of merchandise have increasingly configured the power input port as a standard Universal Serial Bus (USB) connector from the micro connector family, commonly known as a "standard micro-USB receptacle" or, as used herein, a "standard micro-USB jack."

As used herein, the term "power adapter cord" is intended to include any cable, cord, adapter or pigtail containing one or more conductors for providing electrical power to an item of merchandise from an external source of electrical power. By way of example and not limitation, the external source of power in the exemplary embodiments of the invention is a merchandise security device including power electronics for providing an electrical power signal to an electronic item of merchandise at an appropriate operating power or voltage. The power adapter cord functions to power the item of merchandise, or alternatively, to charge an internal battery that operates the item of merchandise in the absence of an external power source. For purposes of illustrating, describing and explaining the present invention, the electronic item of merchandise is provided with a power input port configured as a standard micro-USB jack. Accordingly, the power adapter cord must have a compatible micro-USB plug on the end configured to mate with the standard micro-USB jack of the power input port provided on the item of merchandise. A standard micro-USB jack and standard micro-USB plug connection has a slight interference fit. As such, a limited amount of force is required to engage the plug with the jack and to thereafter remove (i.e. extract) the plug from the jack. Unfortunately, the slight interference fit is not sufficient to prevent a legitimate customer from inadvertently detaching the power adapter cord from the item of merchandise and causing a "false" alarm of the merchandise security device. Likewise, the slight interference fit is not sufficient to prevent a shoplifter from detaching the power adapter cord without damaging the power input port of the item of merchandise.

Accordingly, there exists a need for a merchandise security device including a power adapter cord having a connector that is more securely retained within the power input port of an electronic item of merchandise. There exists a further and more particular need for a power adapter cord for electrically coupling an item of electronic merchandise to a merchandise security device having a connector at one end configured to lock into a power input port provided on the item of merchandise. There exists a specific need for a power adapter cord having a micro-USB plug at one end that is more securely retained within a power input port provided on an electronic item of merchandise that is configured as a standard micro- USB jack so that the power adapter cord cannot be readily detached from the item of merchandise without causing damage to the power input port.

DETAILED DESCRIPTION OF EXEMPLARY EMBODIMENTS

Figure 1:
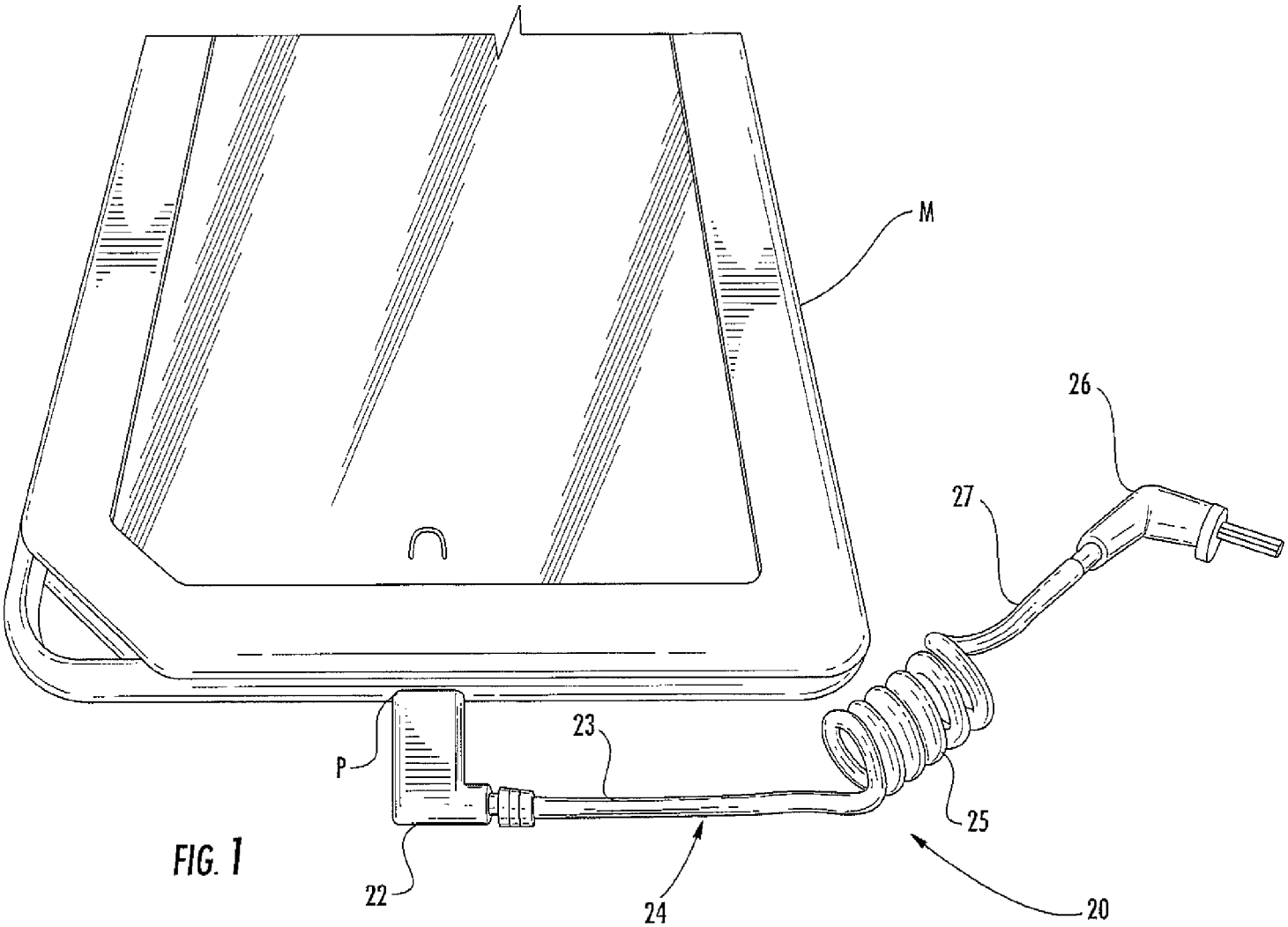
FIG. 1 is a perspective view showing a power adapter cord having a connector at one end according to the present invention that is locked into a power input port provided on an electronic item of merchandise.

The accompanying drawing figures, wherein like reference numerals denote like elements throughout the various views, illustrate one or more exemplary embodiments of a power adapter cord having a connector at one end according to the present invention. As will be understood and appreciated by those skilled in the art, the power adapter cord electrically couples an electronic item of merchandise to an original equipment manufacturer (OEM) power supply, to a merchandise display system, or to a merchandise security device including sensor electronics and optional power electronics in a known manner. By way of example and not limitation, the electronic item of merchandise may be a mobile (e.g. cellular) telephone, audio player, game console, personal data assistant (PDA), digital camera, DSLR, laptop computer, tablet, e-reader or the like, that requires electrical power for a potential purchaser to operate and evaluate the features of the item of merchandise before making a decision whether to purchase the item while the merchandise is being displayed on a merchandise display system and/or protected from theft by a merchandise security device in a display area of a retail store.

In the exemplary embodiments of the invention shown and described herein, a power adapter cord, indicated generally by reference character 20, is electrically coupled to an electronic item of merchandise, indicated generally by reference character M, to provide electrical power to the item while the merchandise is being displayed, powered and protected by a merchandise security device (not shown). The merchandise security device may optionally include power electronics for providing an appropriate operating power or voltage to the item of merchandise M. The merchandise security device may also optionally include sensor electronics for monitoring a security condition and for activating an audible or visible alarm in the event that the electrical connection between the electronic item of merchandise and the merchandise security device is interrupted. For example, the sensor electronics may activate the alarm if the power adapter cord is detached from the item of merchandise M in an unauthorized manner or if the power adapter cord is cut, severed or kinked excessively such that the electrical power signal from the merchandise security device is not delivered to the item of merchandise. However, the merchandise security device need not include power electronics for regulating the power or voltage delivered by the merchandise security device and need not include sensor electronics for monitoring a security condition and activating an alarm. Instead, the merchandise security device and the power adapter cord may merely provide electrical power to the displayed electronic item of merchandise and mechanical security (i.e. a mechanical tether).

Regardless, it will be readily understood and appreciated by those skilled in the art that the invention is applicable to any power adapter cord configured to provide electrical power to an electronic item of merchandise, article of manufacture, product, good or the like, from an external source of electrical power, regardless of whether the item of merchandise is attached to, electrically coupled to, associated with or displayed on a merchandise display system, merchandise security device or the like, in any location and for any purpose. In other words, a power adapter cord 20 according to the present invention may be used in conjunction with any electronic item of merchandise and with any merchandise display system or security device. Alternatively, a power adapter cord 20 according to the present invention may be used alone to electrically couple an electronic item of merchandise M to an external source of electrical power.

FIG. 1 shows a power adapter cord 20 having a connector 22 at one end according to the present invention. As shown, the power adapter cord 20 has a first connector 22 at one end configured for engaging a power input port provided on an electronic item of merchandise M. As previously mentioned, the item of merchandise M may be any item that utilizes power from an external source of electrical power to operate the item and/or to charge an internal power source, such as a rechargeable battery. By way of example and not limitation, the item of merchandise M depicted in FIG. 1 is a tablet, e-reader or the like being displayed in a display area of a retail store for a potential purchaser to operate and evaluate its features before making a decision whether to purchase the item of merchandise. In the exemplary embodiments of the invention shown and described herein, the electronic item of merchandise M has a power input port P that is configured as a standard micro-USB receptacle, commonly referred to as a micro-USB jack, for receiving a compatible micro-USB plug of the connector 22 at the one end of the power adapter cord 20.

The power adapter cord 20 comprises a flexible cable 24 containing at least one conductor for delivering an electrical power signal to the item of merchandise M. Conventionally, the cable 24 comprises at least two conductors encased within a non-conducting (i.e. insulating) sheath in a known manner. As shown, the cable 24 has a first elongate, generally linear portion 23 extending outwardly from the first connector 22. The portion 23 may optionally include a strain relief boot or the like for reducing operating stresses on the cable 24 at the first connector 22. If desired, the cable 24 may include a non-linear portion 25 comprising a plurality of helical coils medially disposed on the cable so that the length of the power adapter cord 20 may be increased as necessary. As shown, the cable 24 further comprises a second elongate, generally linear portion 27 extending between the non-linear portion 25 (if included) and a second connector 26 configured for being electrically connected to an external source of electrical power. The external power source may be any source suitable for providing an electrical power signal to the item of merchandise M at an appropriate operating power or voltage. In a particularly advantageous exemplary embodiment, the external power source is the power electronics of a merchandise display system or merchandise security device. In such case, second connector 26 may be omitted and cable 24 may be electrically connected directly (e.g. hard-wired) to the power electronics in a known manner.

As shown herein, the second connector 26 is a conventional pin or barrel type connector for engaging a power output port provided on the external source of power. In the particularly advantageous exemplary embodiment, the second connector 26 engages a power output port provided on a merchandise display system or merchandise security device, such as a display stand, alarming module, puck, base or the like, for displaying and/or deterring theft of the item of merchandise M. Alternatively, as previously mentioned, the cable 24 of the power adapter cord 20 may be hard-wired to the merchandise display system or merchandise security device. Furthermore, the merchandise display system or merchandise security device may have an internal power source, such as a rechargeable battery, or may be electrically connected to an external source of electrical power. Regardless, a merchandise security device may contain sensor electronics for monitoring and activating and an alarm in the event of a breach of a security condition, as previously described. When utilized in conjunction with an alarming merchandise security device, the cable 24 of the power adapter cord 20 contains one or more additional conductors that define a conductive sense loop between the first connector 22 and the sensor electronics of the merchandise security device. As previously mentioned, the sensor electronics activate the alarm in the event that the first connector 22 is disengaged (removed) from the power input port P of the item of merchandise M, or additionally, if the conductive sense loop is otherwise interrupted (e.g. cut, severed or excessively kinked).

According to the present invention, the first connector 22 is configured to lock into the power input port P of the item of merchandise M so that the power adapter cord 20 cannot be readily detached (separated) from the power input port. In this manner, the power adapter cord 20 eliminates, or at least significantly reduces, false alarms of the alarming merchandise security device due to accidental or malicious removal of the first connector 22 from the power input port P. At the same time, the connector 22 of the power adapter cord 20 prevents a shoplifter from readily removing the connector 22 from the power input port P, and thereby detaching the power adapter cord from the electronic item of merchandise M, without damaging the power input port. As such, a potential shoplifter is discouraged from attempting to steal the item of merchandise M since the power input port P will be damaged and likely rendered inoperable for engaging a compatible connector of a cable, such as a conventional charger cable having a power transformer, to electrically couple the item of merchandise to an external source of electrical power.

A standard micro-USB plug has been used in the past to engage the standard micro-USB jack of the power input port P of the item of merchandise M. A conventional standard micro-USB plug designed for use with the standard micro-USB jack to provide power to the item of merchandise includes a male conducting portion configured for being received within and electrically connected to a corresponding female conducting portion of the standard micro-USB jack. The male conducting portion of the standard micro USB-plug has a pair of longitudinally-extending slots formed therein and configured for receiving a corresponding pair of flexible ribs cantilevered from the body of the micro-USB plug and disposed within the slots. Each rib has a locking latch, also referred to as a "tang," at its distal end that is biased outwardly, from the male conducting portion. The cantilevered ribs, and in particular the locking latches, flex inwardly towards the male conducting portion as the micro-USB plug is inserted into the micro-USB jack. The micro-USB jack includes flexible latching fingers, also referred to as the "receptacle shield," that flex outwardly to ride over the top surfaces of the locking latches, also referred to as the "hook surfaces," and thereby loosely retain the micro-USB plug within the micro-USB jack. The micro-USB plug may be readily removed from the micro-USB jack by applying a sufficient axial extraction force on the body of the micro-USB plug to overcome the biasing force exerted on the ribs such that the ribs flex inwardly and pass by the latching fingers of the micro-USB jack as the micro USB-plug is removed.

The extraction force for a standard micro-USB jack/micro-USB plug connection is specified by the Electronic Industries Association (EIA) 364-13 test specification for the USB 3.0 micro connector family in the Universal Serial Bus 3.0 Connectors and Cable Assemblies Compliance Document Revision 1.02 published on Oct. 4, 2011. The EIA 364-13 USB 3.0 Micro Connector Family specification requires that the initial connector extraction force for a standard-micro-USB jack/standard micro-USB plug connection shall not be less than 10 N (2.25 lbs-force) or more than 25 N (5.62 lbs-force), and shall not be less than 8 N (1.80 lbs-force) or more than 25 N (5.62 lbs-force) after the 10,000 cycles minimum specified by the durability or insertion/extraction cycles specified by EIA 364-09 for the USB 3.0 micro connector family. Accordingly, any modification to the micro-USB plug that causes the connector extraction force with a standard micro-USB jack to exceed about 25 N (5.62 lbs-force) would result in a non-standard micro-USB plug. As used herein, the term "modified micro-USB plug" refers to a non-standard micro-USB plug that causes the connector extraction force with a standard micro-USB jack to exceed about 25 N (5.62 lbs-force).

There are various modifications that can be made to the standard micro-USB plug to provide a friction fit and thereby increase the extraction force required to remove the modified micro-USB plug from a standard micro-USB jack. All such modifications are considered to be within the scope of the disclosure of the present invention and the appended claims. An exemplary embodiment of a modified micro-USB plug according to the invention may be constructed by increasing the bending stiffness of the cantilevered flexible ribs. The increased stiffness may be obtained from a change in the material or the cross-sectional geometry of the ribs that does not interfere with the ability of the modified micro-USB plug to engage with a standard micro-USB jack. Alternatively, a support may be introduced medially between the cantilever point where the ribs are attached to the body of the modified micro-USB plug and the location of the locking latches. The support necessarily reduces the deflection of the ribs at the locking latches so that an increased extraction force is required to flex the latching fingers of the standard micro-USB jack outwardly to remove the modified micro-USB plug. In the event that the deflection of the latching fingers is restricted, the standard micro-USB jack may be damaged by inserting and/or removing the modified micro-USB plug.

Regardless, a standard micro-USB plug may be modified in various embodiments of the present invention to increase the connector extraction force sufficiently that the modified micro-USB plug cannot readily be accidently or maliciously removed from a displayed electronic item of merchandise. Alternatively, a modified micro-USB plug may be configured to increase the extraction force sufficiently that the modified micro-USB plug cannot be removed without damaging the standard micro-USB jack provided on a displayed electronic item of merchandise. In the latter example, a potential shoplifter is discouraged from attempting to steal the electronic item of merchandise because the standard micro-USB jack of the stolen merchandise will be rendered inoperative.

In an exemplary embodiment according to the present invention, the connector extraction force of a modified micro- USB plug may be increased to be greater than about 26 N (5.85 lbs-force). In another exemplary embodiment, the connector extraction force may be increased to be greater than about 26 N (5.85 lbs-force) and less than about 40 N (9.0 lbs-force). In yet another exemplary embodiment, the connector extraction force may be increased to be between about 30 N (6.75 lbs-force) and about 40 N (9.0 lbs-force). In still another exemplary embodiment, the connector extraction force of the modified micro-USB plug may be between about 30 N (6.75 lbs-force) and about 35 N (7.875 lbs-force).

Figure 2:
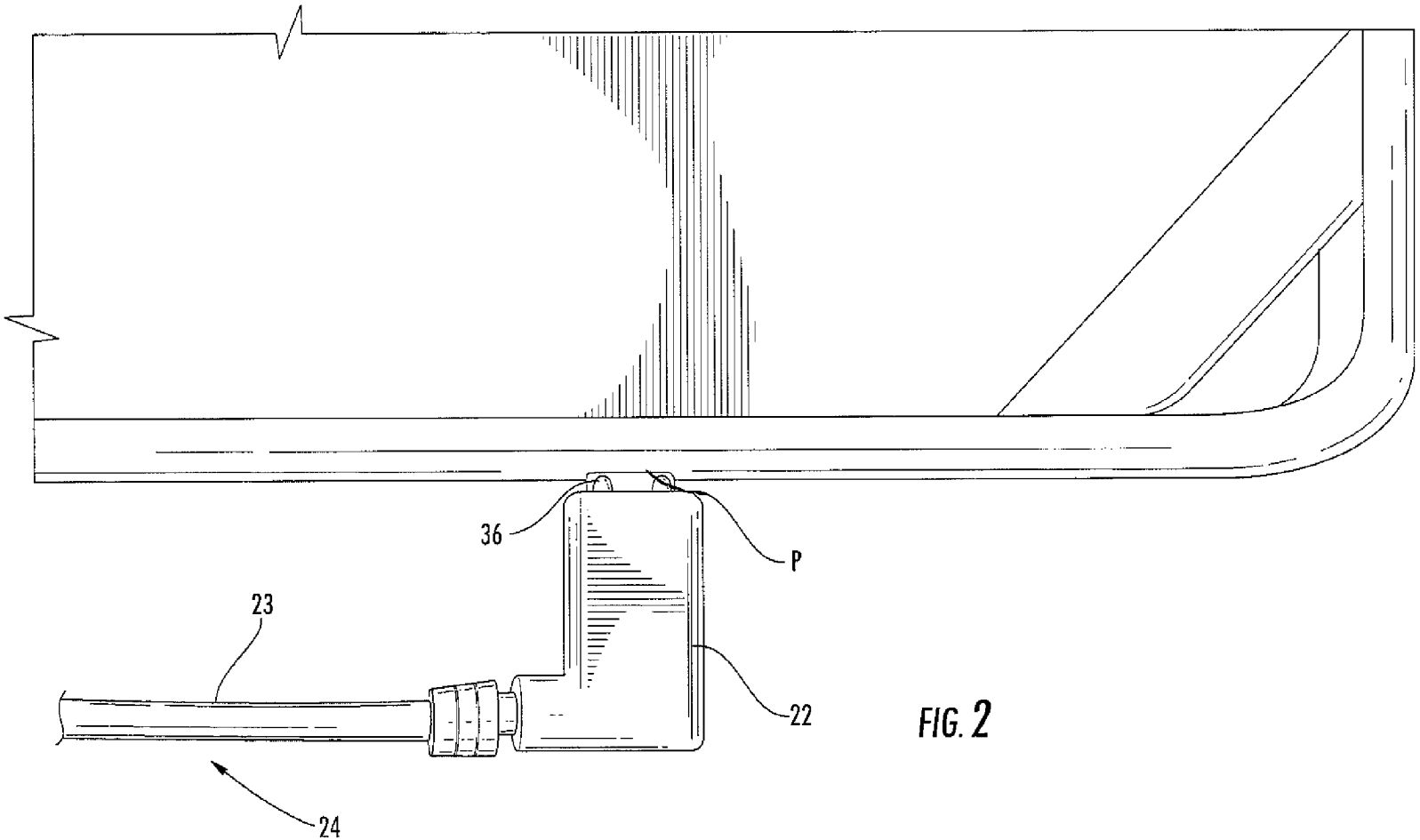
FIG. 2 is a top view showing the connector at the one end of the power adapter cord of FIG. 1 partially disengaged from the power input port of the item of merchandise.
Figure 3:
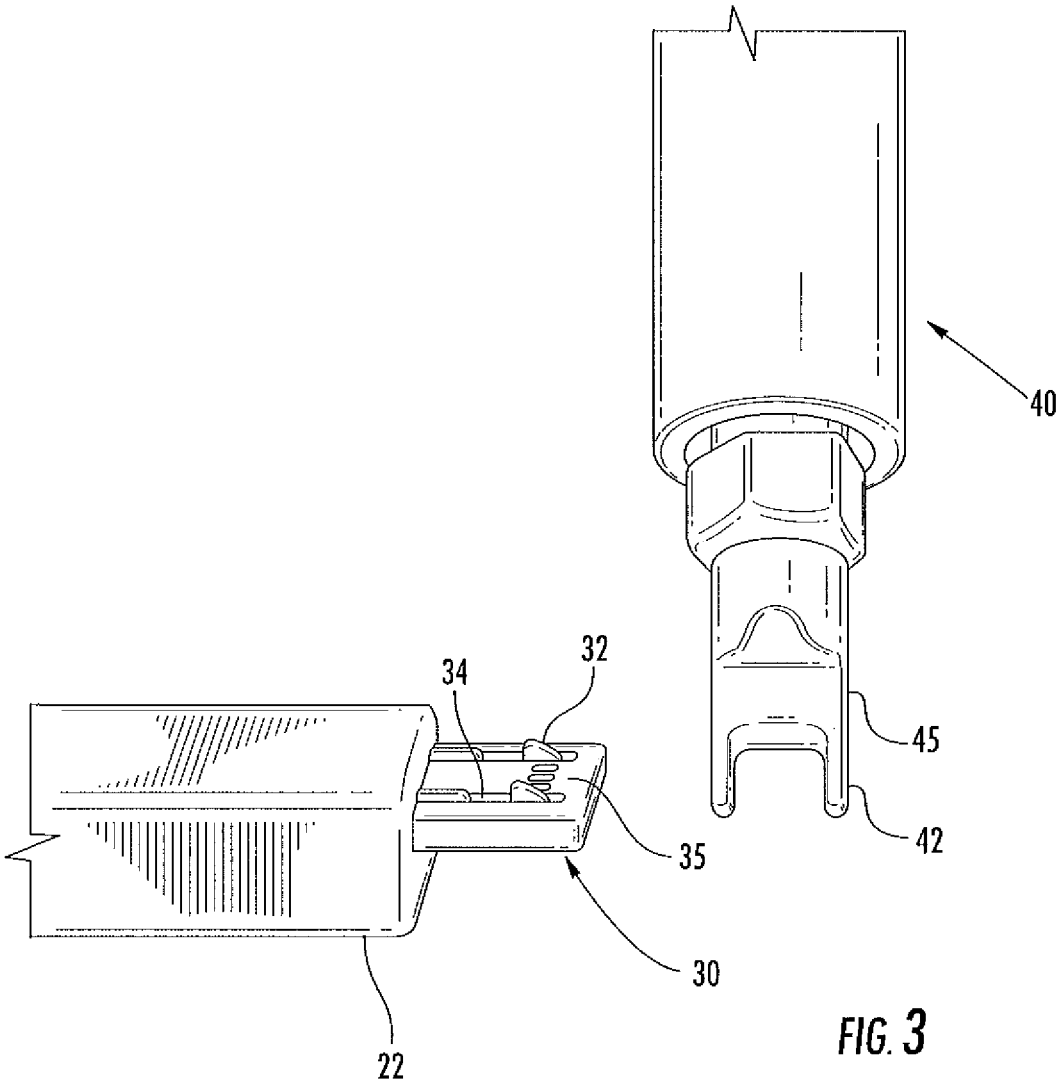
FIG. 3 is an enlarged perspective view of the connector at the one end of the power adapter cord of FIG. 1 and a special tool for disengaging the connector from the power input port of the item of merchandise without damaging the power input port or the connector.
Figure 4:
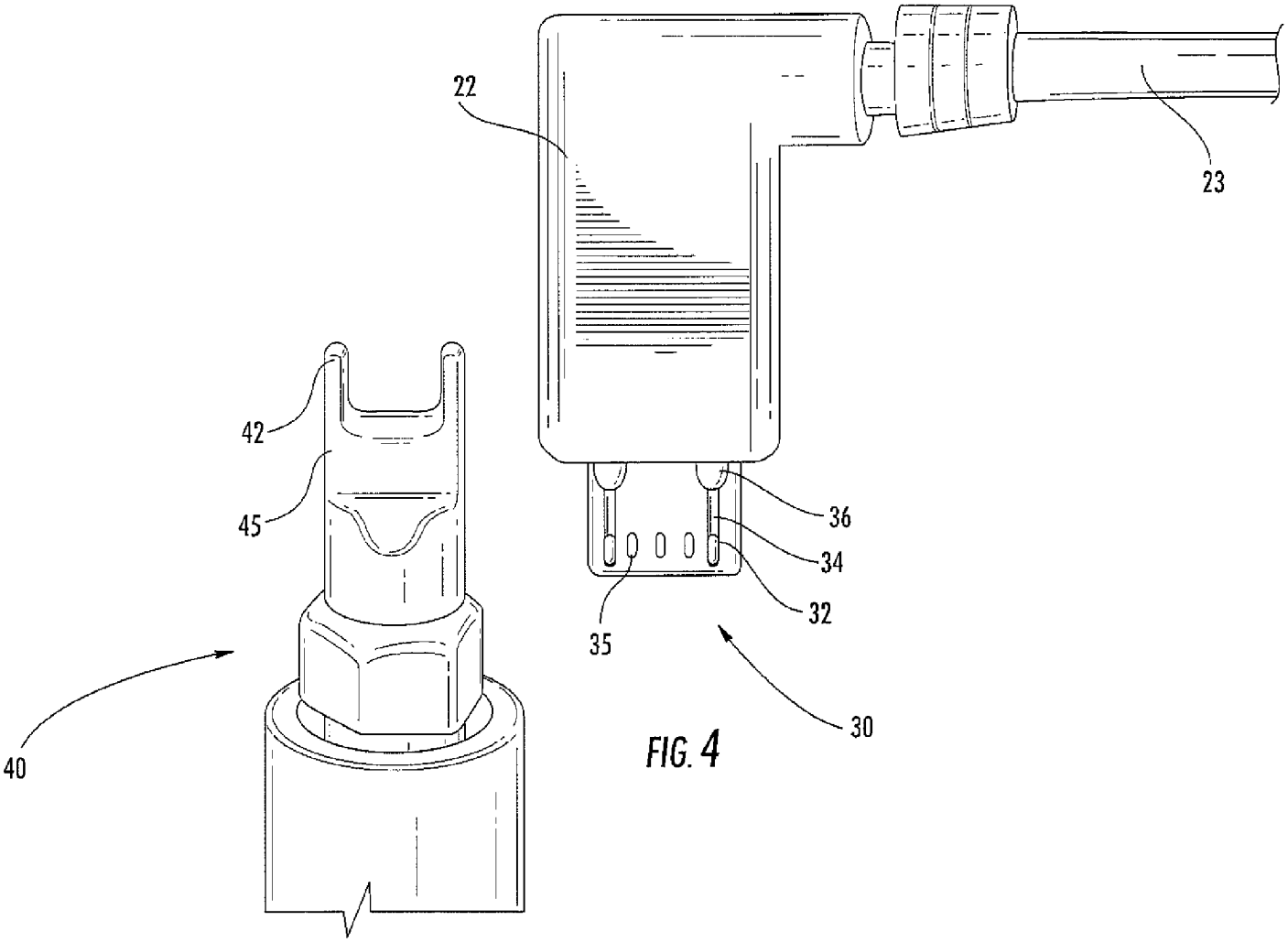
FIG. 4 is a top view of the connector at the one end of the power adapter cord and the special tool shown in FIG. 3.

An exemplary embodiment of a modified micro-USB plug according to the invention is shown in FIGS. 2-4. FIG. 2 shows the first connector 22 of the power adapter cord 20 partially disengaged from the power input port P. In this configuration, the first connector 22 provides a significant increase in resistance to an attempt to manually remove the first connector from the power input port P. As will be described in greater detail with reference to FIG. 3 and FIG. 4, a special tool is required to disengage the first connector 22 from the power input port P without causing damage to the power input port. As a result, false alarms of a corresponding merchandise security device are eliminated or significantly reduced, and a potential shoplifter is discouraged from attempting to steal the merchandise.

FIG. 3 and FIG. 4 show the modified micro-USB plug 30 on the first connector 22 of the power adapter cord 20 and the special tool 40 for eliminating or significantly reducing false alarms of an alarming merchandise security device. The modified micro-USB plug 30 comprises a pair of cantilevered, flexible ribs having locking latches 32 movably disposed within a corresponding pair of longitudinally-extending slots 34, in the manner previously described with reference to a standard micro-USB plug. Like the locking latches of a standard micro-USB plug, the locking latches 32 of the modified micro-USB plug 30 are biased outwardly from the male conducting portion 35 of the micro-USB plug. However, locking latches 32 are biased further outwardly from the surface of the male conducting portion 35. Furthermore, the locking latches 32 are significantly less rounded (i.e. sharper) than the locking latches of a standard micro-USB plug. As a result, locking latches 32 of modified micro-USB plug 30 more securely engage the corresponding latching fingers of the standard micro-USB jack provided on the power input port P of the item of merchandise M.

As best seen in FIG. 4, the male conducting portion 35 of the modified micro-USB plug 30 has oversized openings 36 formed therein at the inner ends of the longitudinal slots 34. Openings 36 are configured (i.e. sized and shaped) to receive a corresponding pair of prongs 42 formed at the distal end 45 of the special tool 40 designed to detach the connector 22 from the power input port of the item of merchandise M. Special tool 40 is intended to be available only to store personnel that are authorized to remove the connector 22 from the power input port P and thereby detach the power adapter cord 20 from the item of merchandise M. When prongs 42 of the special tool 40 are received within the openings 36 of the modified micro-USB plug 30, the prongs act to depress the outwardly biased locking latches 32 sufficiently to allow the locking latches to pass by the corresponding latching fingers of the standard micro-USB jack and thereby permit the modified micro-USB plug to be disengaged from the standard micro-USB jack of the power input port P. As illustrated in FIG. 2, the first connector 22 of the power adapter cord 20 can be partially disengaged from the power input port P of the item of merchandise M so as to expose the openings 36 of the modified micro-USB plug 30 sufficiently to receive the prongs 42 of the special tool 40. Prongs 42 of special tool 40 can then be inserted into the openings 36 to depress the corresponding locking latches 32 of modified micro-USB plug 30 sufficiently to fully disengage (i.e. remove) the first connector 22 from the standard micro-USB jack of the power input port P, and thereby detach the power adapter cord 20 from the item of merchandise M. In this manner, the modified micro-USB plug 30 serves to eliminate or significantly reduce false alarms of the merchandise security device due to accidental or malicious removal of the first connector 22 from the power input port P. Additionally, the modified micro-USB plug 30 operates to discourage a potential shoplifter from attempting to detach the power adapter cord 20 from the electronic item of merchandise because removing the modified micro-USB plug 30 without using the special tool 40 will damage the standard micro-USB jack on the power input port P and possibly render the item of merchandise inoperable.

As previously mentioned, in an exemplary embodiment according to the present invention, the connector extraction force of the modified micro-USB plug 30 may be greater than about 26 N (5.85 lbs-force). In another exemplary embodiment, the connector extraction force may be greater than about 26 N (5.85 lbs-force) and less than about 40 N (9.0 lbs-force). In yet another exemplary embodiment, the connector extraction force may be between about 30 N (6.75 lbs-force) and about 40 N (9.0 lbs-force). In still another exemplary embodiment, the connector extraction force of the modified micro-USB plug 30 may be between about 30 N (6.75 lbs-force) and about 35 N (7.875 lbs-force).

In another exemplary embodiment according to the present invention, the first connector 22 is configured to add a removable locking insert that locks the micro USB plug into the standard micro-USB jack of the power input port provided on the electronic item of merchandise M. Standard locking latches, or alternatively, the locking latches 32 of modified micro-USB plug 30 previously described and shown in FIGS. 2-4, are biased outwardly from the slots formed in the male conducting portion of the micro-USB plug. The locking latches are depressed inwardly as the latching fingers of the standard micro-USB jack pass over the locking latches and subsequently are biased outwardly again when the first connector 22 is fully inserted into the power input port P. Once the micro-USB plug of the first connector 22 is fully inserted into the micro-USB jack of the power input port P, the locking insert is positioned so as to be disposed within the slots formed in the male conducting portion of the micro-USB plug. In an exemplary embodiment, the locking insert is a U-shaped retaining pin and a longitudinally extending opening is formed in the rear of the first connector for receiving the locking insert. The locking insert prevents the ribs, and consequently, the locking latches from being depressed inwardly into the slots. As a result, the micro USB plug of the first connector 22 is locked into the micro-USB jack of the power input port P and cannot be removed without damaging the micro-USB jack and/or the micro-USB plug.

Preferably, the locking insert cannot be readily removed without the use of a special tool (not shown) designed for use with the power adapter cord 20 having the modified first connector 22 and intended to be available only to an authorized person. Alternatively, the locking insert may be manually inserted and removed, or inserted and removed by a magnetically, inductively, optically (e.g. infrared), wirelessly (e.g. radio frequency) or electrically actuated mechanism. For example, the first connector 22 may be configured to house an actuator that moves the locking insert into the slots of the micro-USB plug once the first connector is fully seated into the power input port P. Alternatively, the locking insert may be biased towards the locking position (i.e. into the slots of the micro-USB plug) when the first connector 22 is fully seated into the power input port P. Thereafter, the actuator mechanism may be activated by an authorized person to remove the locking insert from the slots of the micro-USB plug, and thereby permit the micro-USB plug to be disengaged from the standard micro-USB jack of the power input port P. By way of example and not limitation, the actuator mechanism may be activated using a magnet, solenoid, optical transducer or wireless communicator (e.g. transmitter and receiver or transceiver). In addition, the actuator mechanism may be activated at the location of the micro USB-plug, or alternatively, at any location that is in magnetic, optical, wireless or electrical communication with the actuator mechanism. Furthermore, the first connector 22 may be provided with sensor electronics that monitor the location of the locking insert and provide an audible or visible indication of an "armed" or an "unarmed" state of the merchandise display system or merchandise security device, and further, activate an alarm in the event the micro-USB plug is disengaged from the micro-USB jack while the display system or security device is in the "armed" state, as previously described. It should be noted that any of the aforementioned actuation methods may be likewise employed to move the locking latches of the micro-USB plug into and/or out of locking engagement with the latching fingers of the micro-USB jack.

The foregoing has described one or more exemplary embodiments of a power adapter cord having a connector for providing electrical power to an electronic item of merchandise from an external source of electrical power, such as a merchandise display system or a merchandise security device for protecting the item of merchandise from theft or removal by an unauthorized person. The power adapter cord includes a first connector at one end of the power adapter cord that is configured to lock into a power input port provided on the electronic item of merchandise. Exemplary embodiments of a power adapter cord having a connector according to the present invention have been shown and described herein for purposes of illustrating and enabling the best mode of the invention. Those of ordinary skill in the art, however, will readily understand and appreciate that numerous variations and modifications of the invention may be made without departing from the spirit and scope of the invention. Accordingly, all such variations and modifications are intended to be encompassed by the appended claims.

That which is claimed is:

1. A power adapter cord for electrically coupling an electronic item of merchandise to an external source of electrical power, comprising:

a cable containing at least one conductor for providing an electrical power signal to the electronic item of merchandise from the external source of power, the cable having a first connector at one end configured to engage a corresponding connector of a power input port provided on the electronic item of merchandise in a mechanical and electrical connection;

wherein the first connector defines a mechanical and electrical connection with the corresponding connector having a connector extraction force that is greater than about 26 N (5.85 lbs-force) and less than about 40 N (9.0 lbs-force).

2. A power adapter cord according to claim 1, wherein the connector extraction force defined by the mechanical and electrical connection between the first connector of the power adapter cord and the corresponding connector of the power input port is sufficient to prevent accidental or malicious removal of the first connector from the power input port.

3. A power adapter cord according to claim 1, wherein the connector extraction force defined by the mechanical and electrical connection between the first connector of the power adapter cord and the corresponding connector of the power input port is sufficient to prevent the first connector from being removed from the power input port without damaging the corresponding connector.

4. A power adapter cord according to claim 1, wherein the first connector is locked into the power input port so that the power adapter cord cannot be detached from the electronic item of merchandise without damaging the first connector or the corresponding connector.

5. A power adapter cord according to claim 1, wherein the first connector comprises a modified micro-USB plug and the corresponding connector comprises a micro-USB jack.

6. A power adapter cord according to claim 5, wherein the connector extraction force is between about 30 N (6.75 lbs-force) and about 40 N (9.0 lbs-force).

7. A power adapter cord according to claim 5, wherein the connector extraction force is between about 30 N (6.75 lbs-force) and about 35 N (7.875 lbs-force).

8. A power adapter cord according to claim 5, wherein the modified micro-USB plug comprises a male conducting portion having a pair of longitudinally-extending slots formed therein and a corresponding pair of flexible locking latches disposed within the pair of slots and biased outwardly from a surface of the male conducting portion.

9. A power adapter cord according to claim 8, wherein the male conducting portion has a pair of openings formed therein configured to receive a special tool to depress the locking latches inwardly so that the modified micro-USB plug can be readily removed from the micro-USB jack.

10. A power adapter cord according to claim 9, wherein the special tool comprises a pair of prongs corresponding to the pair of openings formed in the male conducting portion.

11. A power adapter cord for electrically coupling an electronic item of merchandise to an external source of electrical power, comprising:

a cable containing at least one conductor for providing an electrical power signal to the electronic item of merchandise from the external source of power, the cable having a first connector at one end configured to engage a corresponding connector of a power input port provided on the electronic item of merchandise in a mechanical and electrical connection;

wherein the first connector comprises a male conducting portion having a pair of longitudinally-extending slots formed therein and a corresponding pair of flexible locking latches disposed within the pair of slots and biased outwardly from a surface of the male conducting portion, wherein the male conducting portion has a pair of openings formed therein configured to receive a special tool to depress the locking latches inwardly so that the first connector can be readily removed from the corresponding connector.

12. A power adapter cord according to claim 11, wherein the first connector comprises a modified micro-USB plug that defines a mechanical and electrical connection with the corresponding connector comprising a micro-USB jack.

13. A power adapter cord according to claim 11, wherein the special tool comprises a pair of prongs corresponding to the pair of openings formed in the male conducting portion.

14. A power adapter cord according to claim 11, wherein the connector extraction force is greater than about 26 N (5.85 lbs-force).

15. A power adapter cord according to claim 11, wherein the connector extraction force is greater than about 26 N (5.85 lbs-force) and less than about 40 N (9.0 lbs-force).

16. A power adapter cord according to claim 11, wherein the connector extraction force is between about 30 N (6.75 lbs-force) and about 40 N (9.0 lbs-force).

17. A power adapter cord according to claim 11, wherein the connector extraction force is between about 30 N (6.75 lbs-force) and about 35 N (7.875 lbs-force).

18. A method for electrically coupling an electronic item of merchandise to an external source of electrical power, comprising:

providing a cable containing at least one conductor for providing an electrical power signal to the electronic item of merchandise from the external source of power, the cable having a first connector at one end configured to engage a corresponding connector of a power input port provided on the electronic item of merchandise in a mechanical and electrical connection; and connecting the first connector to the power input port such that the first connector has an extraction force that is greater than about 26 N (5.85 lbs-force) and less than about 40 N (9.0 lbs-force).

* * * * *